United States Patent [19]

Chalmers et al.

[11] 4,292,781

[45] Oct. 6, 1981

[54] SIDING PANEL SYSTEM WITH MODULAR INSULATING AND MOUNTING UNITS

[75] Inventors: Alexander A. Chalmers, Warren; J. Lynn Gailey, Newton Falls, both of Ohio

[73] Assignee: Alcan Aluminum Corporation, Cleveland, Ohio

[21] Appl. No.: 64,927

[22] Filed: Aug. 8, 1979

[51] Int. Cl.[3] ..... E04D 1/00

[52] U.S. Cl. ..... 52/547; 52/404; 52/409; 52/551

[58] Field of Search ..... 52/522, 529, 545, 543, 52/547, 549, 550, 551, 58, 553, 506, 409, 510, 511, 404

[56] References Cited

U.S. PATENT DOCUMENTS

| | | | |
|---|---|---|---|
| 1,971,411 | 8/1934 | Higley . | |
| 2,632,538 | 3/1953 | Schmidt, Jr. . | |
| 2,648,104 | 8/1953 | Scott et al. | 52/551 X |
| 2,735,143 | 2/1956 | Kearns | 52/553 X |
| 2,877,879 | 3/1959 | Johnson | 52/550 X |
| 3,131,513 | 5/1964 | Grigas et al. . | |
| 3,150,464 | 9/1964 | Shmitt . | |
| 3,236,932 | 2/1966 | Grigas et al. | 174/2 |
| 3,256,650 | 6/1966 | Weckerly et al. | 52/58 |
| 3,347,009 | 10/1967 | Meddick | 52/545 |
| 3,417,531 | 12/1968 | Jones | 52/520 |
| 3,738,076 | 6/1973 | Kessler | 52/547 |
| 3,780,483 | 12/1973 | Mattes | 52/550 |
| 4,054,012 | 10/1977 | Paradisi et al. | 52/544 |

*Primary Examiner*—Carl D. Friedman

*Attorney, Agent, or Firm*—Cooper, Dunham, Clark, Griffin & Moran

[57] ABSTRACT

A siding panel system for use on an exterior building wall or the like, including an overlapping interlocked array of horizontal siding panels 12, wherein the siding panels are secured to the wall by modular insulating and mounting units each comprising an insulating panel 10 and means such as a plurality of horizontal retainer strips 11 disposed in vertically spaced relation on the outer surface thereof for correctly positioning and facilitatingly mounting successive courses of the siding panels in the array. The retainer strips 11 have horizontally extending inward projections 130 received in recesses 28 defined by the insulating panels 10 for positioning the retainer strips properly to engage the successive siding panel courses. The modular units are attached to a wall by fasteners such as nails 52.

14 Claims, 8 Drawing Figures

SIDING PANEL SYSTEM WITH MODULAR INSULATING AND MOUNTING UNITS

TECHNICAL FIELD

This invention relates to surfacing systems for structures such as buildings, and in particular to systems providing thermal insulation and including lapped multiplanar surfacing having interfitted sections secured by fastener or anchor strips at the junctures between sections. Specifically, the invention is directed to horizontal siding panel systems incorporating modular insulating and mounting units.

BACKGROUND OF THE INVENTION

Horizontally elongated siding panels such as roll-formed sheet metal (e.g. aluminum) panels or molded plastic (e.g. vinyl) panels are widely employed for cladding exterior walls of buildings. Typically, the panels are mounted one above another on a wall in parallel, overlapping, interlocked relation with the surface of each panel sloping downwardly and outwardly so as to simulate the appearance of clapboards or other conventional wooden siding, and are attached to the wall at their top margins by suitable fastening means. Each panel has an outwardly projecting lip along its top margin, and an inwardly bent, upwardly opening channel flange at its bottom margin for overlying and interlocking with the lip of the next lower panel on the wall to secure the panel bottom edge (with the panel surface spaced from the surface of the lower panel) and to conceal the fastening means that hold the lower panel.

Siding panels of the type described above have conventionally been secured to walls by fasteners such as nails driven through a flat nailing flange provided at the panel top margin above the locking lip. See, for example, U.S. Pat. No. 3,150,464. This mounting arrangement is disadvantageous in that it is difficult to achieve proper positioning and alignment of the successive courses of panels, especially when installation is being performed by homeowners without experience or special equipment. The panels, being nailed to the wall, are not free to expand or contract with changes in temperature, and it is very difficult to remove them (for instance, to replace a damaged panel); moreover, the provision of a concealed nailing flange above the locking lip involves uneconomical consumption of the relatively expensive siding material.

As siding panels are usually applied to exterior walls of residences or other buildings, it is conventional to provide sheathing inwardly of the panels, and it is also commonly necessary to provide thermal insulation for the walls they cover. Some commercially available siding panels have layers of backers of insulating material adhered to their inner surfaces, both to strengthen them structurally and to provide the requisite insulation; but in general, with panels of this type there are discontinuities in the insulating layer, and consequent impairment of desired insulating effect, adjacent the junctures between panels.

Other wall-insulating arrangements are of course well known, but these are ordinarily unrelated to siding panels and require entirely separate installation with attendant inconvenient consumption of time and labor. Also, alternative panel-mounting arrangements have been proposed, using various types of clips or fastener strips for holding the panels, but these again generally require considerable care and skill in positioning and alignment, and in many cases do not permit ready removal of panels. Thus, they do not fully meet the needs of the "do-it-yourself" homeowner or other relatively unskilled worker.

U.S. Pat. No. 3,780,483 discloses a siding system constituted of insulation panels (backing boards) and interlocked outer siding panels, but does not provide for facilitating the achievement of a proper positioning and alignment of successive courses of siding panels.

SUMMARY OF THE INVENTION

Siding systems that include the modular insulating and mounting units of the type hereinafter described can be positioned, aligned and mounted on walls and the like with no special tools and relatively little skill. Siding systems embodying the present invention are particularly suitable for installation by "do-it-yourself" homeowners without experience or special equipment as well as other relatively unskilled workers and, consequently, overcome many of the problems that have plaqued the prior art.

Broadly stated the invention contemplates the provision of a siding system for a building wall or the like, comprising a plurality of horizontally elongated siding panels mountable on the wall in an overlapping interlocked array in successive courses, one above the other; and a plurality of modular insulating and mounting units mountable on the wall in coplanar relation inwardly of the siding panels, each of the modular units having an outer surface with a vertical extent corresponding to the height of a plurality of courses of siding panels. In a preferred embodiment each of the modular units comprises a flat insulating panel which is semirigid (i.e. self-sustaining in shape) and mountable on the wall in a coplanar edge-abutting relation with the insulating panels of other modular units, and means mountable in predetermined position on the outer surface of such insulating panel for correctly positioning and facilitatingly mounting a plurality of siding panels on each mounted insulating panel.

In a greatly preferred embodiment of the invention the positioning and mounting means comprises a plurality of horizontally elongated retainer strips mountable on each insulating panel by fasteners driven through the strips and thence into the insulating panel, each of these strips having a hook portion that is sufficiently resiliently flexible for snap-fittingly engaging a corresponding locking projection of one of the siding panels along the elongated length of the top edge of the siding panel to secure that siding panel to the mounted insulating panel. Preferably, each of the retainer strips has a horizontally extending, inwardly projecting portion, and each of the insulating panels defines a plurality of recesses extending inwardly from its outer surface for receiving the inwardly projecting portions of an associated plurality of the retainer strips to properly position these strips.

Advantageously, the modular insulating and mounting units are precut to precise shape and dimensions by the manufacturer so that installation of the siding system is very simple. If the retainer strips are employed as the positioning and mounting means, the manufacturer also preferably forms the positioning recesses at proper locations on the insulating panels and, if desired, prepositions and secures (e.g. with staples) the strips to the insulating panels. The snap-fitting engagement of the siding panels to the modular units permits the siding panels to expand and contract with changes in temperature, and to be formed without nailing flanges, affording advantageous savings in siding panel material; moreover, such panels can be removed from the wall, if necessary, with relative ease.

The modular units can be applied to a wall over existing sheathing, or directly to vertical studs (in new construction), in which case the units themselves constitute the sheathing for the wall. The installer levels the lowest course of the modular units on the wall to be covered, fastens them to the wall, and thereafter simply applies the rest of the units to the wall, an operation which (because of the modular character of these units) requires no special skill or care in positioning. Each modular unit is mounted by driving fasteners (e.g. nails) through them and then into the wall. The installer then fits the siding panels into place on the mounted modular units using the positioning and mounting means on the outer surface of each of the modular units working upwardly from the lowest course; since such means is already properly positioned on the modular units the siding panels are inherently correctly located.

DETAILED DESCRIPTION

Figure 1:
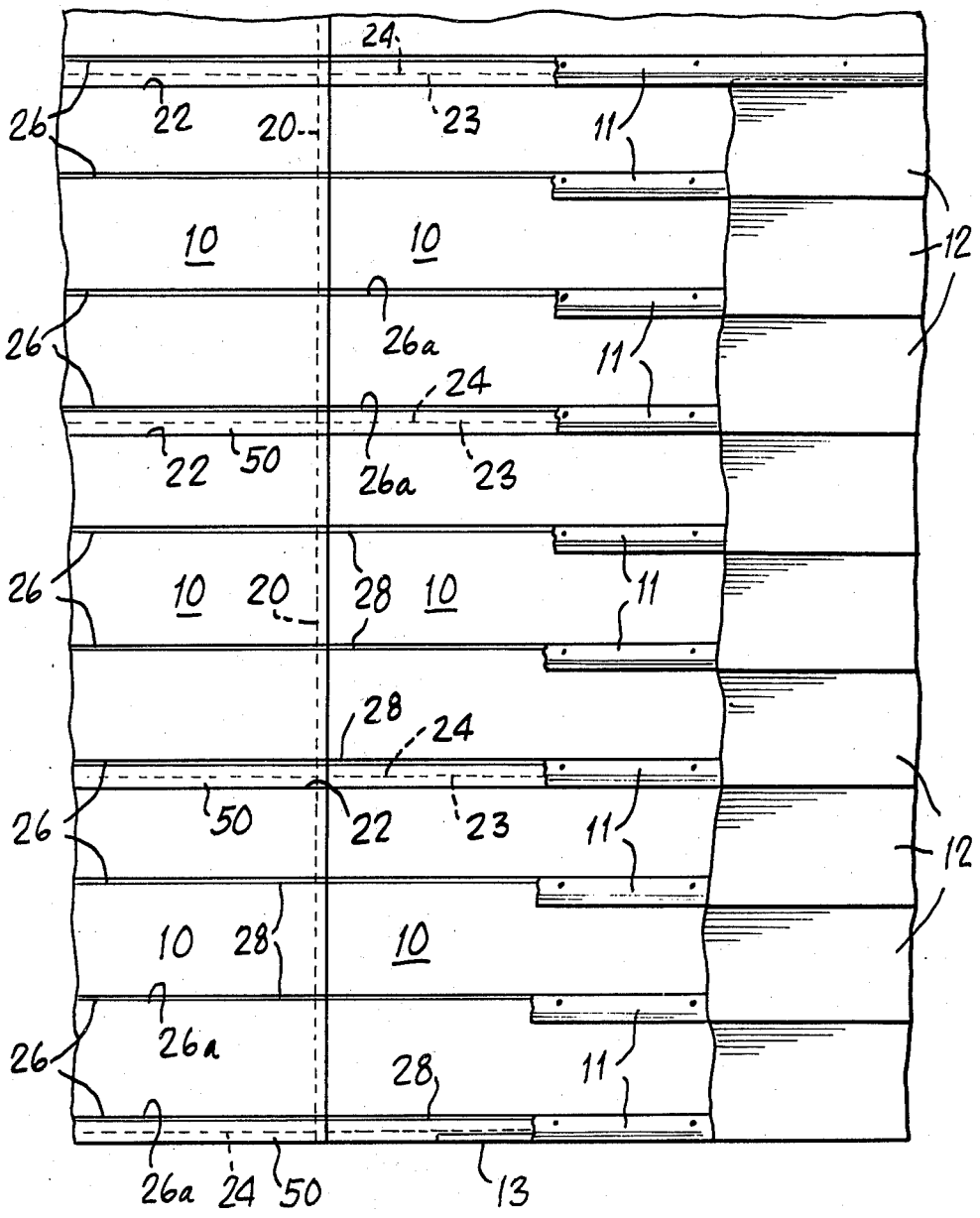
FIG. 1 is a fragmentary elevational view of a siding system embodying the present invention in a particular form, with the siding panels and retainer strips partially cut away for clarity of illustration.

In accordance with a preferred embodiment of the invention a siding system that is mountable on a wall or the like is provided that comprises two basic components: First, a plurality of horizontally elongated siding panels mountable on the wall in an overlapping interlocked array in successive courses, one above another, each of the siding panels having a top edge with a first longitudinal locking projection and a bottom edge with a second longitudinal locking projection for interlocking with the first projection of the next lower siding panel in the array; and Second, a plurality of modular insulating and mounting units mountable on the wall in coplanar relation inwardly of the siding panels, each of the modular units having an outer surface with a vertical extent corresponding to the height of a plurality of the courses of siding panels and means mountable on such outer surface for correctly positioning and facilitatingly mounting the siding panels on the modular units.

It will be understood that terms such as "inner" or "inwardly" and "outer" or "outwardly" herein designate directions respectively toward and away from the wall on which a panel is mounted, and that these terms, as well as terms such as "upper" or "top" and "lower" or "bottom," are used with reference to the orientation of a panel when mounted on a wall with the long dimension of the panel extending horizontally; also, that "wall" includes sloping surfaces such as roofs as well as vertical wall surfaces.

Each of the modular insulating and mounting units of the present invention comprises a horizontally elongated, semirigid, rectangular insulating panel with flat, parallel major inner and outer surfaces, and means mountable in predetermined position on the outer surface of each insulating panel for positioning and mounting the siding panels on the insulating panels. The insulating panels may be constituted of polystyrene, for example, or any other insulating material having similar qualities of rigidity.

The positioning and mounting means may comprise any known clip or fastener system for holding panels, provided such system is mountable on the insulating panel in predetermined position and permits facilitated, correctly oriented application of the siding panels to the mounted insulating panels. For example, a plurality of prepositioned, horizontally elongated, resiliently flexible retainer strips with hook portions for snap-fittingly engaging corresponding longitudinal locking projections on the top edges of the siding panels and which are mounted in horizontally oriented, parallel, spaced relation on each insulating panel are particularly advantageous since they permit not only simplified, correctly oriented application of the siding panels, but also permit expansion and contraction of the siding panels due to temperature changes, as well as ready removal in the event replacement becomes necessary.

Vertical stringer systems that are prepositioned on the insulating panels can also be applied as such positioning and mounting means. A typical vertical stringer for this purpose is a vertically elongated roll-formed thin metal strip having a plurality of preformed integral resilient clips, opening downwardly, located at vertically spaced intervals along its length. The clips are produced by striking out portions of the central web of the metal strip and forming the struck-out portions to a shape suitable for resiliently engaging and holding corresponding locking projections on the top edges of the siding panels; the spacing between successive clips on a stringer is equal to the spacing between the top edges of adjacent (lower and upper) siding panels when the panels are interlocked. A plurality of these stringers are prepositioned (by the manufacturer) on each insulating panel, and nailed or otherwise fastened (by the manufacturer or the installer) side by side on the insulating panel in vertically oriented, parallel, spaced relation (e.g. 16 inches or 24 inches apart on centers) with their respective clips horizontally aligned, i.e. the lowermost clips of all the stringers are lying in a first common horizontal line, the next higher clips of all the stringers are lying in a second common horizontal line, and so forth, each stringer extending from the lower edge of the insulating panel to the top of the panel.

The thickness of the insulating panels is governed by the requirements that the panels be semi-rigid (self-sustaining in shape) and that they provide the desired level of thermal insulation. The overall shape and size is governed by the requirements that they enhance a substantially facilitating installation and yet enable convenient transport and handling prior to installation. Accordingly, each panel is advantageously equal in height to several courses of siding panels and long enough so that only a few insulating panels will usually be needed for an ordinary wall.

Each of the insulating panels advantageously will have means formed on or attached to the outer surface of the panels for locating the fasteners, clips, retainer strips or stringers used to mount the siding panels, thus permitting the siding panels to be easily mounted in predetermined correctly oriented positions of alignment by the installer. For example, when the retainer strips are used as the positioning and mounting means, the manufacturer advantageously will cut a plurality of positioning recesses that extend horizontally over the full length of the panel for receiving corresponding inwardly projecting portions of the retainer strips. When vertical stringers are used the manufacturer will likewise advantageously cut a plurality of positioning recesses that extend in vertically oriented, parallel, spaced relation from the top of each insulating panel to the bottom for receiving corresponding inwardly projecting portions formed on or attached to the stringers; alternatively, the manufacturer can form vertically oriented parallel markings in spaced relationship on each insulating panel for vertically positioning the stringers.

Each siding panel comprises an elongated thin sheet article, self-sustaining in shape, being (for example) molded of a suitable plastic such as vinyl or formed from thin gauge metal such as steel or aluminum strip, preferably with its outer surface prepainted or otherwise protectively or decoratively precoated. The major extent of each siding panel is a flat central web with its upper and lower edges bent to form appropriate longitudinal locking projections for engagement with the particular positioning and mounting means employed with the modular insulating and mounting units of the present invention.

Installation of siding systems embodying the invention is accomplished by, first, positioning and mounting the modular units on the wall and then, second, applying the siding panels to the mounted modular units using the prepositioned positioning and mounting means incorporated on the outer surface of each modular unit. Installation of the modular units is accomplished by leveling the lowest course on the wall to be covered (an operation that can be facilitated by first securing correctly oriented starter strips on the wall), fastening the modular units to the wall and, thereafter, simply applying the rest of the units to the wall in coplanar edge-abutting relation to the lowest course.

With the siding system of the invention most of the task of proper alignment and positioning is advantageously performed by the manufacturer, enabling the installation to be accomplished by a homeowner or other relatively unskilled worker. As assembled on the wall the modular units provide an essentially continuous insulating layer; thus, with a single installing operation, the wall is provided with effectively full thermal insulation and with a facing of siding panels.

By way of further illustration of the invention, reference may be made to the drawings and the illustrated embodiment:

The siding system of the invention in its illustrated embodiment, as mounted (for example) on an exterior vertical building wall, comprises (FIG. 1) a plurality of flat insulating panels 10 secured to the wall in coplanar edge-abutting relation to each other; a plurality of vertically spaced, horizontally elongated retainer strips 11 mounted on the outer surface of each insulating panel 10; an array of parallel, overlapped, interlocking horizontal siding panels 12 secured to the wall (outwardly of the insulating panels and retainer strips) by engagement with the retainer strips 11; and a plurality of starter strips 13 secured to the wall inwardly of the lowermost course of insulating panels 10 and overlying the lower edge of such insulating panels, all as hereinafter further explained.

Figures 2, 3, 4:
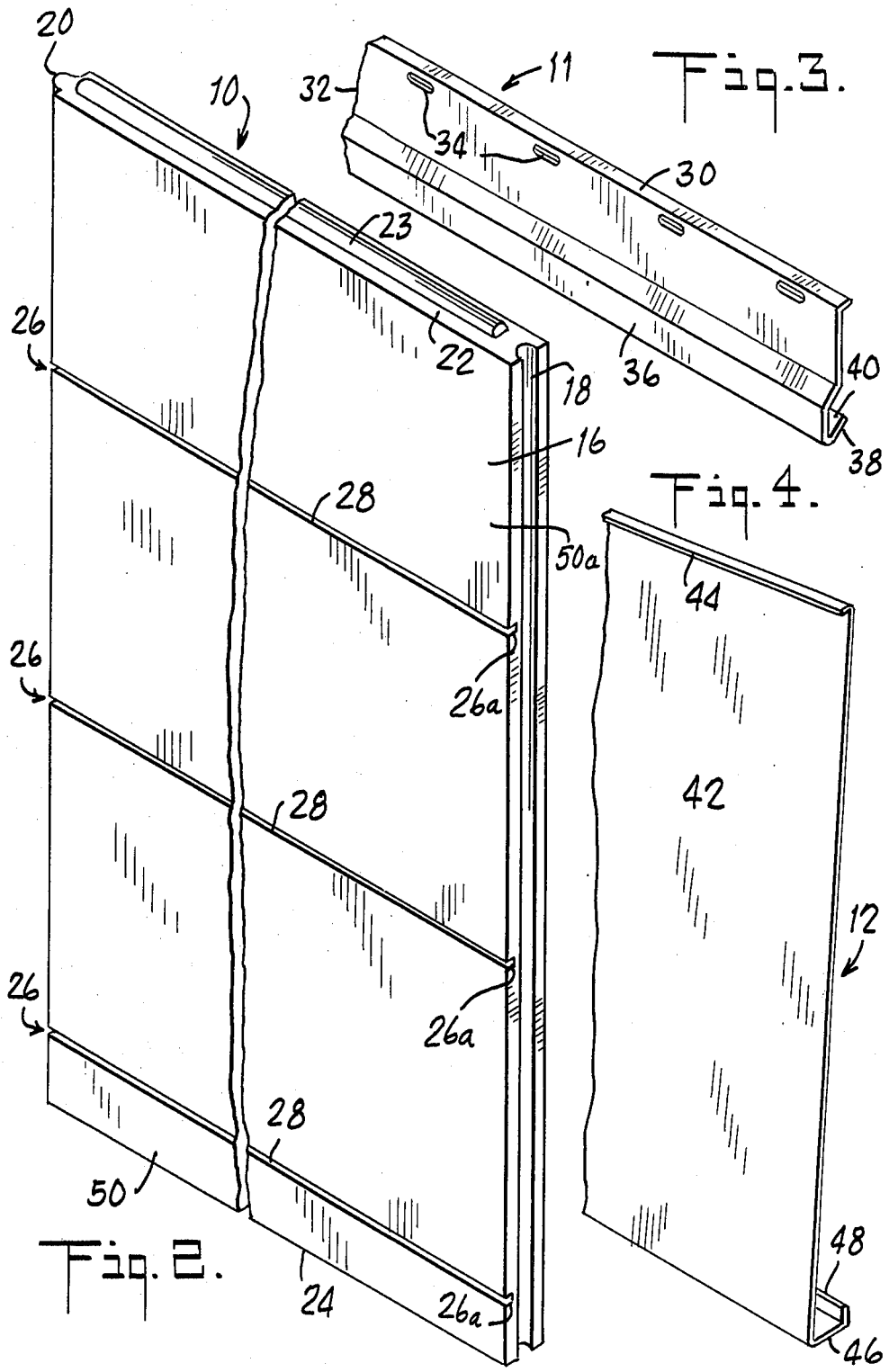
FIG. 2 is an enlarged fragmentary perspective view of an insulating panel of the system of FIG. 1.
FIG. 3 is an enlarged fragmentary perspective view of a retainer strip of the system of FIG. 1.
FIG. 4 is an enlarged fragmentary perspective view of a siding panel of the system of FIG. 1.

Each of the insulating panels 10, as shown in FIG. 2, is a horizontally elongated, semirigid, rectangular panel with flat, parallel major inner and outer surfaces, the outer surface being designated 16. One vertical side edge of the insulating panel 10 is formed with a longitudinal groove 18 and the opposite vertical side edge is formed with a longitudinal bead 20 for mating with the groove 18 of an adjacent panel to provide a tight joint therebetween. Likewise, the top horizontal edge is formed with a longitudinal bead 23 and the bottom horizontal edge is formed with a longitudinal groove 25 for mating with the corresponding longitudinal bead 23 of an immediately subjacent insulating panel. A tight joint on all four sides of each of the panels 10 is thereby provided to increase the overall insulating and wind filtration resistance characteristics of the siding system. The insulating panel may be constituted of polystyrene, for example, or any other thermally insulating material which is semi-rigid in the described configuration, many such materials being known in the art.

The thickness of the panel 10 is governed by the requirements that the panel be semi-rigid (self-sustaining in shape) and that it provide adequate insulation for the building on which it is used, while overall shape and size are selected with regard to the desirability of substantially facilitating installation (as compared with separately nailing individual siding panels to a wall) yet enabling convenient transport and handling prior to installation. Thus, each panel 10 is made about equal in height to several courses (three, in the embodiment shown) of siding panels 12, and long enough so that only a few insulating panels will usually be needed in any given course of insulating panels, but it is substantially smaller than the ordinary wall on which it is to be mounted. Typical dimensions for the panel 10 are about two feet in height, about eight feet in length, and from about $\frac{3}{4}$ inch to about $1\frac{1}{2}$ inches in thickness.

Each insulating panel 10 defines a plurality of vertically spaced positioning recesses 26 each extending horizontally over the full length of the panel, for receiving and positioning the retainers 11. Each of these recesses, in the form shown, has an upwardly facing, flat, horizontal ledge or seat surface **26*a* extending inwardly from the panel outer surface 16. The panel 10 of FIG. 2 defines three recesses 26 which are horizontal grooves 28 cut into the panel outer surface 16 (with their lower side walls respectively constituting the three seat surfaces 26*a*). The vertical spacing between adjacent grooves 28 is equal to the vertical distance between the bottom edges of successive courses of the siding panels 12 when the siding panels are mounted in interlocked relation on the insulating panel as shown, e.g. in FIG. 6. The combined vertical extent of short portion 50 and upper portion 50*a* is also equal to the vertical distance between the bottom edges of successive courses of siding panels 12 so that when successive courses of insulating panels 10 are mounted one above another the spacing between the uppermost groove 28 of one insulating panel and the lowermost groove 28 of the next higher insulating panel will be the same as any two vertically adjacent grooves 28** on one insulating panel.

Each of the retainer strips 11 (FIG. 3) is a unitary, horizontally elongated member, self-sustaining in shape but sufficiently resiliently flexible for snap-fitting engagement with a siding panel 12 (as hereinafter described) and is conveniently molded or otherwise formed of a thermoplastic resin; each retainer strip 11 is equal in horizontal length to one of the insulating panels 10 (e.g., about eight feet) but much smaller in vertical height than one of the siding panels 12 (e.g. about 1½ inches). More particularly, each retainer strip 11 comprises an upper horizontally extending longitudinal mounting flange or leg 30 and a horizontally extending longitudinal hook or clip 32 formed integrally with and depending from the leg 30. To provide the leg 30, the upper edge portion of the strip 11 is bent so as to project horizontally inwardly from the strip inner surface along its full length for overlying and engaging one of the seat surfaces 26*a* of an insulating panel 10, while the lower portion of the strip projects downwardly from the outer extremity of the leg 30 (so as to overlie the panel outer surface 16) and has a plurality of nail holes 34 spaced along its length. The lower edge portion 36 of the clip 32 projects initially outwardly and downwardly, with its lower margin 38 bent inwardly and upwardly along its full horizontal length to form an inwardly and upwardly opening channel 40 for engaging and holding longitudinal edge portions of siding panels 12.

Each siding panel 12 (FIG. 4) is an elongated rectangular thin sheet article, self-sustaining in shape, being (for example) molded of a suitable plastic such as vinyl or formed from thin-gauge sheet metal such as aluminum strip with its outer surface prepainted or otherwise protectively and decoratively precoated. The major extent of each siding panel 12 is a flat central web 42; its top edge is bent outwardly and downwardly to constitute a longitudinal locking lip 44, and its bottom edge is bent first inwardly and then upwardly to constitute an upwardly opening channel flange 46 on the inner side of the panel 12 for interlocking with the top edge of an immediately subjacent siding panel on a wall and for holding the panel bottom edge away from the surface of the subjacent siding panel to simulate the appearance of a conventional wooden clapboard. Each siding panel 12 may have a horizontal length of eight feet (or preferably more, e.g. as much as 12 feet), and, in the example of system dimensions mentioned above, may be designed to have an exposed vertical extent of about eight inches, i.e. when assembled in overlapping relation with other siding panels 12, so that three courses of siding panels correspond in height to one (2-foot-high) insulation panel.

Figure 5:
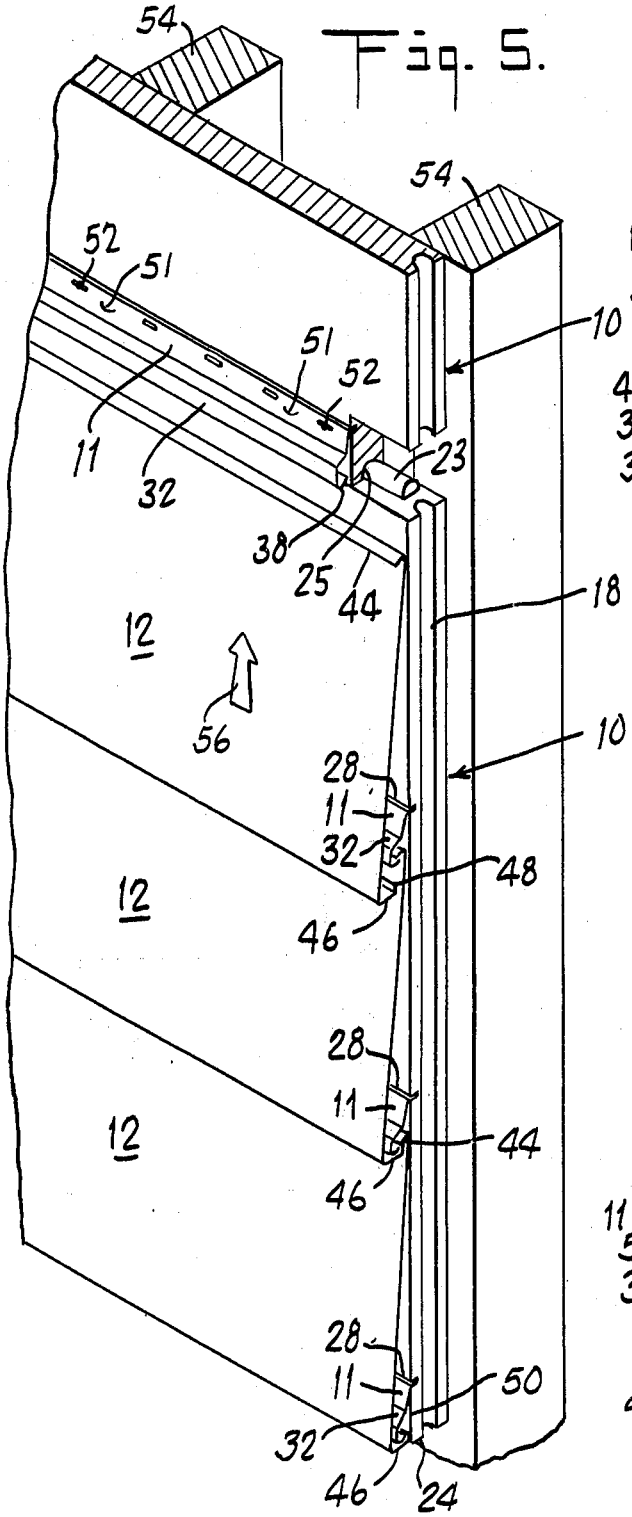
FIG. 5 is a similarly enlarged fragmentary perspective view of the FIG. 1 system, showing parts of two insulating panels with their associated retainer strips and siding panels mounted on a wall, and illustrating the manner in which the siding panels are installed.

Specifically, as best seen in FIGS. 4 and 5, the top locking lip 44 of each siding panel 12 is shaped to be insertable under and behind the clip 32 of a retainer strip 11 mounted on a seat surface 26*a* of an insulating panel 10, and, when thus inserted, to interlock with the clip portion 38 for securing the siding panel to a wall on which the insulating panel is mounted. The bottom channel flange 46 of the siding panel has an inner upstanding leg 48 for fitting under and behind a clip 32 of another retainer strip 11 (immediately below the retainer engaged by the lip 44 of the same siding panel) to interlock with that clip and with the lip 44 of a lower siding panel received therein, for securing the bottom edge of the siding panel to the wall. Owing to the above-described spacing between vertically adjacent seat surfaces 26*a*, when the lip 44 of a siding panel 12 is lockingly engaged by one retainer strip 11 mounted on an insulating panel, the bottom channel flange 46 of the same siding panel is lockingly engaged by the next lower retainer strip 11 in the siding system.

As shown in FIG. 1, the insulating panels 10 are so designed that when successive courses of them are mounted one above another on a wall, the spacing between the uppermost seat surface 26*a* of one insulating panel and the lowermost seat surface 26*a* of the next higher insulating panel is the same as the above-described spacing between any two vertically adjacent seat surfaces 26*a* on one insulating panel; i.e. uniform vertical spacing between successively higher seat surfaces 26*a* (and thus between successively higher retainer strips 11) is provided over the full vertical extent of the wall, regardless of the number of courses of insulating panels used, as is necessary to enable a continuous sequence of overlapping courses of siding panels to be mounted on the wall. The retainer strip 11 positioned in the lowest one of the grooves 28 of each of the lowermost panels 10 constitutes a starter strip, for engaging the bottom channel flange 46 of a siding panel 12 of the lowermost course of siding panels on the wall; short portion 50 of each of the insulating panels 10 in the lowermost course extends below the bottom groove 28 to back up the last mentioned retainer strip 11.

Figure 7:
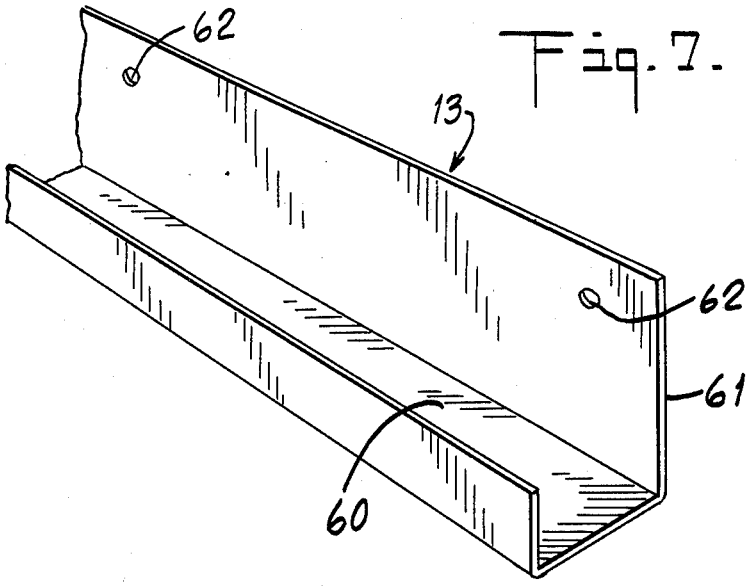
FIG. 7 is an enlarged fragmentary perspective view of a starter strip in a particular form for use with the system of FIG. 1.
Figure 8:
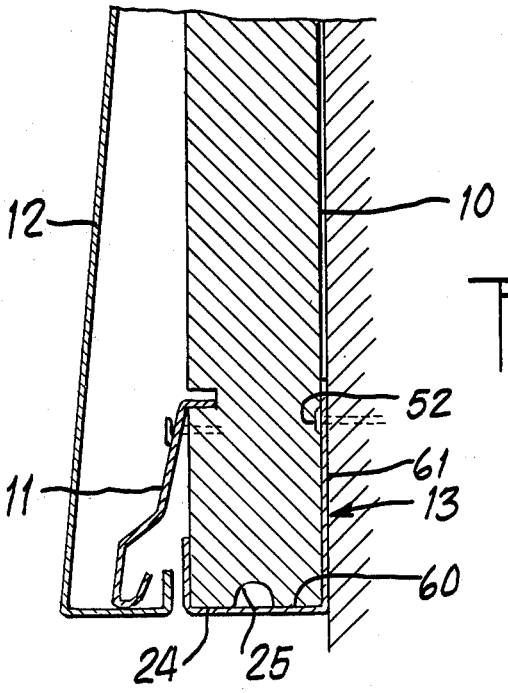
FIG. 8 is an enlarged fragmentary vertical cross-sectional view of the system of FIG. 1 illustrating particularly the starter strip of FIG. 7.

Each starter strip 13 (FIGS. 7 and 8) is a unitary horizontally elongated member that is self-sustaining in shape and can be extruded or otherwise formed of a thermoplastic resin or a metal (e.g. an alloy of aluminum); each starter strip is equal in horizontal length to one of the insulating panels 10 (e.g. about eight feet) but much smaller in vertical height than one of the siding panels 12. Each starter strip 13 comprises a horizontally extending longitudinal upwardly opening channel flange 60 that depends from and is formed integrally with a horizontally extending longitudinal upwardly projecting leg 61. To provide flange 60, the lower edge portion of leg 61 is bent so as to project horizontally outwardly from the outer surface of leg 61 along its full length (so as to overlie the lower edge 24 of the lowermost course of panels 10) and then upwardly (so as to overlie a lower portion of the outer surface 16 of panel 10). The upper portion of leg 61 has a plurality of nail holes 62 spaced along its length. The horizontal extent of flange 60 is substantially equivalent to the thickness of panels 10. The use of starter strip 13 has the advantage of providing protection for the bottom edge 24 of panel 10 from weathering, and wear and tear.

Preferably, the retainer strips 11 are preassembled by the manufacturer on the respective seat surfaces 26*a* of the insulating panels 10 and lightly secured thereto with suitable fasteners such as staples 51 applied through their portions 32 into the insulating panels. Thus, as received at a building site, the retainer strips are already properly positioned and held on the insulating panels. Also conveniently, and preferably, the insulating panels 10 with their associated retainer strips 11 are provided as modular units, i.e. all the panels 10 are identical to each other in size, being cut by the manufacturer to the exact dimensions (within acceptable tolerances) required for proper assembly so that they can be simply installed, one after another, on a wall.

The installation of the siding system of FIGS. 1–8 (e.g. on a conventional vertical exterior building wall)

may now be readily understood. The starter strips 13 are first placed along the lower part of the wall, levelled as with a conventional spirit level and secured to the wall by fasteners such as nails 52 driven through nail holes 62. Assuming that the retainer strips are stapled to the insulating panels as described above, the insulating panels 10 of the lowermost course are then placed along the lower part of the wall with the lower edge 24 of each panel 10 being received in channel flange 60 of each associated starter strip 13 and the side bead 20 of each panel 10 being inserted in the groove 18 of the next laterally adjacent panel. Owing to the modular character of the panels 10 and the correct alignment of the starter strips 13 the retainer strips 11 of all of the panels 10 in the course will be substantially in register. Each panel 10 is secured to the wall by fasteners such as nails 52 driven through nail holes 34 of the retainer strip 11 (and thence through the insulating panel) into the wall. The panels 10 may be laid over existing siding or sheathing, or directly over vertical studs 54 (FIG. 5) in which case the insulating panels themselves constitute the sheathing of the wall and the nails are driven into the studs. A plurality of nails 52 are thus driven through each of the retainer strips 11 into the wall at horizontally spaced locations; these nails, and the retainer strips, bear the load of the siding panels subsequently mounted on the retainer strips.

Once the panels 10 of the lowermost course are secured to the wall, installation of the remaining courses of insulating panels 10 proceeds quickly. Owing to the accurate sizing of the insulating panels and the accurate positioning of their grooves 28 by the manufacturer, they are simply laid up on the wall (in successively higher courses) one after another, in edge-abutting relation to the panels already installed (the longitudinal groove 25 of each panel 10 being mated with the corresponding longitudinal bead 23 of the corresponding panel 10 in the course immediately below the course of panels being installed), aligned by eye for proper register of their retainer strips, and nailed to the wall in the manner described above, viz. by nails 52 driven through the nail holes of the retainer strips. The bead-and-groove forms on the top, bottom and side edges of each of the panels 10, in addition to providing tight joints between adjacent panels, ensure proper orientation of the panels. When all the insulating panels have been mounted on the wall in the described edge abutting relation, they cooperatively constitute an essentially continuous layer of insulation of substantially uniform thickness extending over the entire wall, with their outer surface 16 all lying substantially in a common plane. Of course, portions of some of the panels are cut off at the building site as necessary to accommodate windows and doors and to conform the assembly of panels to the overall dimensions of the wall, but this is readily accomplished by simple measuring and sawing operations.

Figure 6:
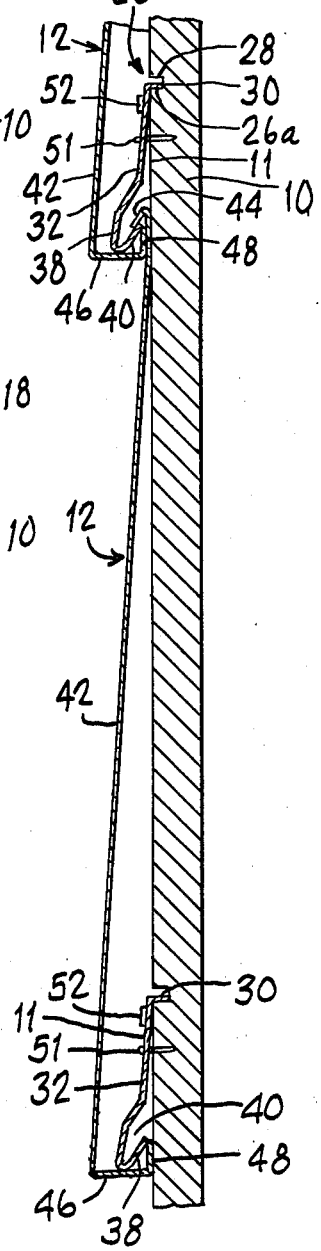
FIG. 6 is an enlarged fragmentary vertical cross-sectional view of the siding system of FIG. 1.

The assembly of thus-mounted insulation panels 10 on the wall presents an array of vertically spaced horizontal rows of retainer strips 11 extending entirely across the wall, fully secured in place, and (by virtue of their positioning in the predefined recesses 28) properly located to receive the siding panels 12 without any need for individual alignment of the siding panels; i.e. the siding panels are inherently aligned as they are snapped into engagement with the prepositioned retainer strips. Beginning then with the lowest course of siding panels, and working progressively upward, the installer snap-fits the siding panels into place on the retainer strips as indicated in FIG. 5. Each siding panel 12 is initially held immediately beneath that one of the retainer strips 11 which is to receive its lip 44, and is then manually pushed vertically upward (arrow 56, FIG. 5) to force its lip 44 under and behind the clip margin 38 of that strip. Owing to the resilient flexibility of the strip 11, the clip 32 moves progressively outward until the edge of the lip 44 passes above the edge of margin 38, and then snaps back inwardly toward the wall, positively engaging and retaining the lip 44 as illustrated in FIG. 6. Simultaneously with this insertion of the lip 44 of a siding panel under the clip 32 of one retainer strip 11, the leg 48 of the bottom flange 46 of the same panel moves upwardly under the clip 32 of the next lower retainer strip 11, to interlock with the lip 44 of the lower siding panel previously snapped into place on the latter strip, and thereby to secure the bottom edge of the newly-installed panel to the wall while enclosing and concealing the lower retainer strip.

By this simple snap-fitting operation, all the siding panels of the successively higher courses are rapidly assembled on the wall, completely covering the insulating panels and retainer strips, each securely held along both top and bottom edges, and cooperatively presenting the appearance of conventional clapboard siding. No special tools or skills are needed for this installation procedure, because proper alignment of the siding panels is assured through the sizing of the insulating panels and cutting of the grooves 28 by the panel manufacturer. As will be appreciated, positioning and nailing the relatively few insulating panels on the wall is much easier than individually positioning and nailing the far larger number of siding panels. Since the panels themselves are not nailed, but held by clips, they are capable of movement to accommodate thermal expansion and contraction, and the omission of concealed nailing flanges above the lips of the siding panels affords an economically advantageous saving of siding panel material; moreover, the siding panels can be removed with relative ease (as compared with conventional nailed siding panels) if necessary for repair or replacement. In addition, manufacture of the components of the siding system, including the grooved insulating panels, is relatively facile and inexpensive.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A siding system for a building wall or the like, comprising (a) a plurality of horizontally elongated siding panels mountable on the wall in an overlapping interlocked array in successive courses, one above another, each of said siding panels having a top edge with a first longitudinal locking projection and a bottom edge with a second longitudinal locking projection for interlocking with the first projection of an immediately subjacent siding panel in the array;

(b) a plurality of modular insulating and mounting units mountable on the wall in coplanar relation inwardly of the siding panels, each of said modular units having an outer surface with a vertical extent corresponding to the height of a plurality of the courses of siding panels; and (c) means mountable in predetermined position on said outer surface for positioning and mounting the siding panels on the modular units, said mounting means comprising for each modular unit a plurality of horizontally elongated resiliently flexible retainer strips, each of said strips having a hook portion for snap-fittingly engaging a first locking projection of one of said siding panels along the length thereof to secure said one siding panel to an associated modular unit;

(d) each of said retainer strips having a horizontally extending inwardly projecting portion and the outer surface of each of the modular units defining a plurality of recesses extending inwardly from said outer surface for receiving the inwardly projecting portions of said strips to properly position said strips, said recesses being spaced apart vertically by distances equal to the distance between the second locking projections of siding panels in successive courses of said array.

2. A siding system as defined in claim 1 wherein each of said modular insulating and mounting units includes a semirigid insulating panel with flat parallel major inner and outer surfaces.

3. A system as defined in claim 1, wherein said recesses are horizontal grooves extending across the outer surfaces of said modular units.

4. A system as defined in claim 1, wherein said inwardly projecting portions of said strips are horizontally elongated legs extending along the inner surfaces of said strips.

5. A system as defined in claims 1 or 2, including a plurality of horizontally elongated starter strips mountable on the wall adjacent the lower edge of each of the modular units in the lowermost course of said modular units, said strip including a horizontally extending longitudinal upwardly opening channel flange for receiving said lower edge.

6. In a siding system for a wall or the like, for use with an overlapping interlocked array of horizontally elongated siding panels disposed in successive courses, one above another, each of said siding panels having a top edge with a first longitudinal locking projection and bottom edge with a second longitudinal locking projection for interlocking with the first projection of an immediately subjecent siding panel in the array, a modular insulating and mounting unit comprising (a) a semi-rigid insulating panel with flat parallel major inner and outer surfaces mountable on the wall inwardly of the array of siding panels, said outer surface having a vertical extent corresponding to the height of a plurality of said courses of siding panels in the array; and (b) means, mountable in predetermined position on said outer surface for positioning and mounting siding panels, comprising a plurality of horizontally elongated retainer strips mountable on the outer surface of said insulating panel and each having a hook portion of snap-fittingly engaging a first locking projection of one of said siding panels along the length thereof to secure said siding panel to the outer surface of said insulating panel;

(c) each of said retainer strips including a horizontally extending, inwardly projecting portion and said insulating panel defining a plurality of recesses extending inwardly from said outer surface for receiving the inwardly projecting portions of said strips to properly position said strips, said recesses being spaced apart vertically by distances equal to the distances between the second locking projections of siding panels in successive courses of said array, and said strips being disposed on the outer surface of said insulating panel with their inwardly projecting portions respectively received in said recesses.

7. An insulating and mounting unit as defined in claim 6, wherein said recesses are horizontal grooves in said outer surface and wherein said inwardly projecting portions of said strips are horizontal longitudinal legs projecting inwardly from the inner surfaces of the strips.

8. An insulating and mounting unit as defined in claim 6 or 7, including means for attaching said strips to said insulating panel prior to installation on a wall.

9. An insulating and mounting unit as defined in claim 6, wherein each of said insulating panels has opposed edges respectively formed with a longitudinal bead and a longitudinal groove for matingly engaging edges of other ones of said insulating panels. D

10. On a building wall or the like, a siding system comprising:

(a) an array of horizontally elongated siding panels disposed outwardly of the wall in overlapping interlocked relation in successive courses, one above another, each of said panels having a top edge with an outwardly projecting longitudinal lip and a bottom edge with an inwardly projecting longitudinal channel flange for interlocking with the lip of an immediately subjacent panel in the array;

(b) a plurality of flat semi-rigid insulating panels disposed in coplanar, edge-abutting relation between the array of siding panels and the wall, each of said insulating panels having an outer surface corresponding in vertical extent to the height of a plurality of said courses of siding panels; and (c) for each of said insulating panels means mounted in predetermined position on the outer surface of each of said insulating panels for positioning and mounting a plurality of said siding panels on said outer surface, said means comprising a plurality of horizontally elongated resiliently flexible retainer strips, each of said strips including an inwardly opening longitudinally extending hook for snap-fittingly engaging and retaining the lip of one of said siding panels to hold the siding panel on the wall and for being received with the channel flange of a second siding panel interlocked with said last-mentioned lip;

(d) each of said insulating panels including a plurality of upwardly- facing seat surfaces extending horizontally along and inwardly from said insulating panel outer surface in parallel relation to each other, said seat surfaces corresponding in number to said plurality of courses of siding panels, and adjacent seat surfaces being spaced apart vertically by a distance equal to the vertical distance between the bottom flanges of two successive courses of siding panels in said array; and each of said retainer strips including a top edge having an inwardly projecting longitudinal leg extending therealong for overlying and engaging a seat surface of one of said insulating panels thereby to properly position the strip on said last-mentioned insulating panel.

11. A system as defined in claim 10 wherein each of said retainer strips includes a portion depending from said leg in overlying relation to the outer surface of one of said insulating panels, and for each of said strips a plurality of horizontally spaced fasteners extending through the depending strip portion and through the insulating panel disposed inwardly thereof into the wall, for securing the strips and insulating panels to the wall.

12. A system as defined in claim 10, wherein each of said insulating panels has a plurality of said horizontal grooves in its outer surface, the lower side walls of said grooves constituting a plurality of said seat surfaces.

13. A system as defined in claim 10, wherein the top edge of said siding panels is bent outwardly and downwardly to constitute said lip.

14. A siding system as defined in claim 2 or 10, wherein each of said insulating panels has opposed edges respectively formed with a longitudinal bead and a longitudinal groove for matingly engaging edges of other ones of said insulating panels.

* * * * *

UNITED STATES PATENT AND TRADEMARK OFFICE

CERTIFICATE OF CORRECTION

PATENT NO. : 4,292,781

DATED : October 6, 1981

INVENTOR(S) : Alexander A. Chalmers et al.

It is certified that error appears in the above-identified patent and that said Letters Patent are hereby corrected as shown below:

Col. 1, line 54, "layers of" should read --layers or-- .

Col. 2, line 21, "plaqued" should read --plagued-- .

Signed and Sealed this

*Ninth* Day of *November 1982*

[SEAL]

*Attest:*

GERALD J. MOSSINGHOFF

*Attesting Officer* *Commissioner of Patents and Trademarks*